United States Patent [19]

Contois et al.

[11] 4,301,226

[45] Nov. 17, 1981

[54] CRYSTALLIZATION INHIBITING MIXTURES OF ARYLMETHANE PHOTOCONDUCTORS

[75] Inventors: Lawrence E. Contois, Webster; Norman G. Rule, Rochester, both of N.Y.

[73] Assignee: Eastman Kodak Company, Rochester, N.Y.

[21] Appl. No.: 94,524

[22] Filed: Nov. 15, 1979

Related U.S. Application Data

[63] Continuation-in-part of Ser. No. 962,433, Nov. 20, 1978, abandoned.

[51] Int. Cl.[3] ..... G03G 5/06

[52] U.S. Cl. ..... 430/72; 430/73; 430/74; 430/96; 430/71

[58] Field of Search ..... 430/72, 71, 73, 74, 430/83, 520, 572

[56] References Cited

U.S. PATENT DOCUMENTS

| | | | |
|---|---|---|---|
| 3,542,544 | 11/1970 | Seus et al. | 430/73 |
| 3,542,547 | 11/1970 | Wilson | 430/72 |
| 3,615,402 | 10/1971 | Rule | 430/74 |
| 3,820,989 | 6/1974 | Rule et al. | 430/74 |

*Primary Examiner*—Richard L. Schilling
*Assistant Examiner*—John L. Goodrow
*Attorney, Agent, or Firm*—Torger N. Dahl

[57] ABSTRACT

Photoconductive layers containing a crystallization inhibiting mixture of at least two different organic photoconductors selected from the class of photoconductors represented by the following formula

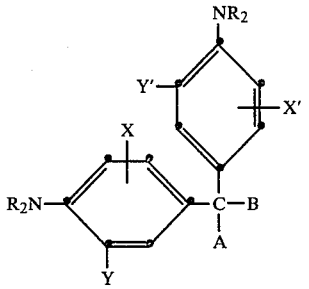

I.

wherein

R is selected from the group consisting of alkyl, aralkyl, and substituted and unsubstituted aryl;

X and X' which may be the same or different are selected from the group consisting of hydrogen, alkyl, alkoxy, hydroxyl, $NO_2$ and halogen;

Y and Y' which may be the same or different are selected from the group consisting of hydrogen, alkyl, alkoxy, hydroxyl, halogen and $NO_2$;

A and B, when taken alone may be the same or different, are selected from the group consisting of hydrogen, alkoxy, hydroxyl, halogen, substituted or unsubstituted aryl, alkyl, cycloalkyl group having four to ten carbon atoms and cycloalkenyl group having four to eight carbon atoms; or A and B, when taken together, represents sufficient atoms to form together with the carbon to which they are attached a substituted or unsubstituted carbocyclic ring having from 4 to 10 carbon atoms, are disclosed.

11 Claims, No Drawings

CRYSTALLIZATION INHIBITING MIXTURES OF ARYLMETHANE PHOTOCONDUCTORS

This application is a continuation-in-part application of U.S. Ser. No. 962,433 filed Nov. 20, 1978 in the names of Contois and Rule now abandoned.

This invention relates to photoconductive layers. In particular, the invention provides novel photoconductive layers containing a mixture of organic photoconductors.

The use of photoconductive elements in electrophotographic processes is well known. Such elements generally comprise a conductive support bearing a photoconductive layer.

The photoconductive layer generally comprises a photoconductive material dispersed in an electrically insulating binder. Among the materials which have been described as useful organic photoconductive materials are tri-substituted methanes such as disclosed in U.S. Pat. No. 3,820,989 granted to Rule et al on June 28, 1974 and tri-arylmethane leuco bases such as disclosed in U.S. Pat. No. 3,542,547 granted to Wilson on Nov. 24, 1970.

It has been discovered that photoconductive layers comprising the organic photoconductive materials disclosed in the aforementioned patents are capable of producing high resolution images at suitable exposures. However, it has been discovered that such photoconductive layers containing a single photoconductor often will not perform well after a period of storage or if the element was prepared using elevated drying temperatures. In these stored or dried layers, the organic photoconductor tends to migrate to the surface of the layer and crystallize out in a snake-like pattern. Such crystallization or "snake" defects impair the capability of the photoconductive layer for producing high resolution images.

SUMMARY OF THE INVENTION

We have now discovered that the crystallization or "snake" problem suffered by the above-mentioned photoconductive layers can be overcome with an electrophotographic layer comprising an electrically insulating binder and a crystallization inhibiting mixture of at least two different organic photoconductors selected from the class of organic photoconductors represented by the formula

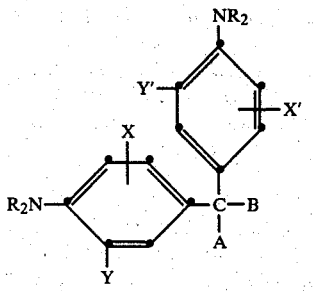

I.

wherein

R is selected from the group consisting of alkyl, aralkyl, and substituted and unsubstituted aryl;

X and X' which may be the same or different are selected from the group consisting of hydrogen, alkyl, alkoxy, hydroxyl, $NO_2$ and halogen;

Y and Y' which may be the same or different are selected from the group consisting of hydrogen, alkyl, alkoxy, hydroxyl, halogen and $NO_2$;

A and B, when taken alone may be the same or different, are selected from the group consisting of hydrogen, alkoxy, hydroxyl, halogen, substituted or unsubstituted aryl, alkyl, cycloalkyl group having four to ten carbon atoms and cycloalkenyl group having four to eight carbon atoms; or A and B, when taken together, represents sufficient atoms to form together with the carbon to which they are attached a substituted or unsubstituted carbocyclic ring having from 4 to 10 carbon atoms;

and wherein each organic photoconductor may be present in said layer up to the limit of its solubility in the binder.

In a preferred embodiment of the present invention, the crystallization inhibiting mixture of at least two organic photoconductors is selected from the group consisting of bis (4-N,N-dialkylamino-2-alkylaryl)-4-alkylarylmethane; 1,1-bis (4-N,N-dialkylamino-2-alkylaryl)-2-alkylpropane and 4,4'-bis(dialkylamino)-2,2'-dialkyltriarylmethane.

The terms alkyl and alkoxy as used herein refer to compounds generally containing from 1 to 10 carbon atoms and includes substituted alkyl groups. Aryl and the prefix ara- refer to substituted and unsubstituted phenyl, naphthyl and anthryl groups wherein the substituents are selected from the group consisting of dialkylamino, alkylamino, amino as well as the groups represented by X, X', Y and Y'.

Formula I, representing the class of organic photoconductors useful in the present invention, includes certain of the organic photoconductive materials disclosed in aforementioned U.S. Pat. No. 3,542,547 and U.S. Pat. No. 3,820,989. The disclosure of these two patents are expressly incorporated herein by reference.

Photoconductive elements comprising photoconductive layers of the type just described, are much more resistant to the formation of "snakes" resulting from crystallization of the organic photoconductors than elements comprising photoconductive layers containing a single photoconductor represented by Formula I.

DETAILED DESCRIPTION OF THE INVENTION

The photoconductive compositions of the present invention are homogeneous and heterogeneous.

Homogeneous photoconductive compositions are prepared in a conventional manner, for example, by simply admixing the selected formula I photoconductors and the electrically insulating binder in a coating solvent. Each of the selected formula I photoconductors may be included in the composition up to the solubility of each in the binder. Electrophotographic elements are formed from the homogeneous photoconductive compositions by simply coating the composition on a support having a conductive layer such as described hereinafter.

Useful heterogeneous compositions include aggregate photoconductive compositions of the type disclosed in U.S. Pat. No. 3,615,415 granted to Light, Oct. 26, 1971. Aggregate photoconductive compositions may be prepared by several techniques, such as by fuming as disclosed in Light; or the so-called "dye first" technique described in Gramza et al, U.S. Pat. No. 3,615,396 issued Oct. 26, 1971; or the so-called "shearing" method described in Gramza, U.S. Pat. No.

3,615,415 issued Oct. 26, 1971; or the two-stage dilution technique described in Kryman et al U.S. Pat. No. 3,679,408 issued July 25, 1972. Still another method of preparation involves preforming the finely-divided aggregate particles such as is described in Gramza et al, U.S. Pat. No. 3,732,180 and simply storing these preformed aggregate particles until it is desired to prepare the charge-transport layer. At this time, the preformed aggregate particles may be dispersed in an appropriate coating vehicle together with the desired electrical insulating polymeric binder and coated as a layer on a suitable substrate to form a heterogeneous photoconductive element.

In addition to the organic photoconductors defined by formula I, triphenylamine type photoconductors, including substituted triphenylamines, are useful in increasing the speed of the photoconductive compositions of the present invention. Especially useful organic photoconductors in this regard are triphenylamine, 4-diphenylaminochalcone, bis(4-diphenylaminobenzol) acetone, 4-hydroxymethyltriphenylamine, tri-2-tolylamine, 4-carboxytriphenylamine, 4-(α-hydroxyethyl)-triphenylamine, 4,4',4''-trimethoxytriphenylamine and tri-p-tolylamine. Other useful triphenylamine photoconductors are disclosed in, for example, U.S. Pat. No. 3,180,730 granted to Klupfel et al, Apr. 27, 1965.

The total amount of organic photoconductors included in the layer may vary widely but preferably ranges from about 5 to about 40 weight percent based on the total dry weight of the layer. The solubility of each organic photoconductor may be determined by evaluating an organic photoconductor series in a film forming binder and determining by differential thermal analysis at what concentration the organic photoconductor forms a separate phase.

Representative Formula I organic photoconductors from which the mixture of at least two photoconductors of the present invention may be selected, is set out in Table I.

TABLE I 1. 4,4'-bis(diethylamino)-2,2'-dimethyltriphenylmethane
2. 4',4''-bis(diethylamino)-2,6-dichloro-2',2''-dimethyltriphenylmethane
3. 4,4'-bis(diethylamino)-2,2'-dimethyldiphenyl-α-naphthylmethane
4. 2',2''-dimethyl-4,4',4''-tris(dimethylamino)-triphenylmethane
5. 4',4''-bis(diethylamino)-4-dimethylamino-2',2''-5',5''-tetramethyltriphenylmethane
6. 4',4''-bis(diethylamino)-2-chloro-2',2''-dimethyl-4-dimethylaminotriphenylmethane
7. 4',4''-bis(diethylamino)-4-dimethylamino-2,2',2''-trimethyltriphenylmethane
8. 4',4''-bis(dimethylamino)-2-chloro-2',2''-dimethyltriphenylmethane
9. 4',4''-bis(dimethylamino)-2',2''-dimethyl-4-methoxytriphenylmethane
10. 4,4'-bis(benzylethylamino)-2,2''-dimethyltriphenylmethane
11. 4,4'-bis(diethylamino)-2,2',5,5'-tetramethyltriphenylmethane
12. 4,4'-bis(diethylamino)-2,2'-diethoxytriphenylmethane
13. 4,4'-bis(diethylamino)-2,2'-dimethyldiphenyl-β-naphthylmethane
14. 4,4'-bis(diethylamino)-2,2'-dimethyldiphenyl-9-anthrylmethane
15. 4,4',4''-trisdiethylamino-2,2',2''-trimethyltriphenylmethane
16. 1,1-bis(4-N,N-diethylamino-2-chlorophenyl)-2-phenylethane
17. 1,1-bis(4-N,N-diethylamino-2-methoxyphenyl)-2-phenylethane TABLE I-continued 18. bis(4-N,N-diethylaminophenyl)cyclopent-2-enyl methane
19. bis(4-N,N-diethylamino-2-methylphenyl)cyclobut-2-enyl methane
20. 1,1-bis(4-N,N-diethylaminophenyl)-3-phenylpropane
21. 1,1-bis(4-N,N-diethylaminophenyl)-2-phenylethane
22. 1,1-bis(N,N-diethylaminophenyl)butane
23. bis(4-N,N-diethylaminophenyl)cyclohexylmethane
24. 1,1-bis(4-N,N-diethylaminophenyl)-2-methylpropane
25. 1,1-bis(4-N,N-diethylaminophenyl)heptane
26. bis(4-N,N-diethylaminophenyl)cyclohex-3-enylmethane
27. 1,1-bis(4-N,N-diethylaminophenyl)-2-ethylhexane
28. 1,1-bis(4-N,N-diethylamino-2-methylphenyl)-3-phenylpropane
29. 1,1-bis(4-N,N-diethylamino-2-methylphenyl)-2-phenylethane
30. 1,1-bis(4-N,N-diethylamino-2-methylphenyl)butane
31. 1,1-bis(4-N,N-diethylamino-2-methylphenyl)cyclohexylmethane
32. 1,1-bis(4-N,N-diethylamino-2-methylphenyl)-2-methylpropane
33. 1,1-bis(4-N,N-diethylamino-2-methylphenyl)butane
34. bis(4-N,N-diethylamino-2-methylphenyl)cyclohex-3-enylmethane
35. bis(4-N,N-diethylamino-2-methylphenyl)-4-methylphenylmethane
36. bis(4-diethylamino)1,1,1-triphenylethane
37. bis(4-diethylamino)tetraphenylmethane
38. 1,1-bis(4-N,N-diethylaminophenyl)cyclohexane
39. 1,1-bis(4-di-p-tolylaminophenyl)cyclohexane
40. 1,1-bis(4-di-p-tolylaminophenyl)-2-methylpropane
41. 1,1-bis(4-N,N-diethylaminophenyl)-4-methylcyclohexane
42. 1,1-bis(4-N,N-dipropylaminophenyl)cyclohexane
43. 1,1-bis(4-N,N-diethylaminophenyl)-1-(4-methylphenyl)-ethane
44. 4-N,N-diethylaminotetraphenylmethane
45. 4,4'-bis(diethylamino)-4'',4'''-dichlorotetraphenylmethane
46. 4,4'-bis(dipropylamino)tetraphenylmethane
47. 4,4'-bis(diethylamino)-4''-isopropyl-2,2'-dimethyltriphenylmethane The photoconductive layers of the invention can also be spectrally and/or chemically sensitized by the addition of effective amounts of sensitizing compounds. Sensitizing compounds useful with the photoconductive compounds of the present invention can be selected from a wide variety of materials, including such materials as pyrylium dye salts including thiapyrylium dye salts and selenapyrylium dye salts disclosed in VanAllan et al, U.S. Pat. No. 3,250,615; fluorenes; aggregate-type sensitizers of the type described in U.S. Pat. No. 3,615,414; aromatic nitro compounds of the kind described in U.S. Pat. No. 2,610,120; anthrones like those disclosed in U.S. Pat. No. 2,670, 284; quinones, U.S. Patent No. 2,670,286; benzophenones, U.S. Pat. No. 2,670,287; thiazoles, U.S. Pat. No. 2,732,301; mineral acids; carboxylic acids such as maleic acid, di- and trichloroacetic acids, and salicyclic acid; sulfonic and phosphoric acids; and various dyes, such as cyanine (including carbocyanine), merocyanine, diarylmethane, thiazine, azine, oxazine, xanthene, phthalein, acridine, azo, anthraquinone dyes and the like and mixtures thereof. The sensitizers preferred for use with the compounds of this invention are selected from pyrylium salts including selenapyrylium salts and thiapyrylium salts, and cyanine dyes including carbocyanine dyes such as disclosed in U.S. Patent 3,597,196.

Where a sensitizing compound is employed with the binder and organic photoconductors to form a photoconductive layer, a suitable amount of the sensitizing compound may be mixed with the coating composition so that, after thorough mixing, the sensitizing compound is uniformly distributed in the coated element. Other methods of incorporating the sensitizer may, however, be employed consistent with the practice of this invention.

The amount of sensitizer that can be added to the organic photoconductor layer to give effective increases in speed can vary widely. The optimum concentration in any given case will vary with the specific photoconductors and sensitizing compound used. In general, substantial speed gains can be obtained where an appropriate sensitizer is added in a concentration range from about 0.0001 to about 30 percent by weight based on the total dry weight of the photoconductive layer. Normally, a sensitizer is added in an amount by weight of from about 0.005 to about 5.0 percent by weight.

Preferred electrically insulating binders for use in preparing the present organic photoconductive layers are film-forming, hydrophobic polymeric binders having fairly high dielectric strength. Materials of this type comprise styrene-butadiene copolymers; silicone resins; styrene-alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and polymethacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly[ethylene-co-alkylenebis- (alkyleneoxyaryl)-phenylenedicarboxylate]; phenolformaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloarylates; poly(ethylene-co-neopentyl terephthalate); and vinyl acetate such as poly(vinyl-m-bromobenzoate-co-vinyl acetate); etc.

Methods of making resins of this type have been described in the prior art, for example, styrene-alkyd resins can be prepared according to the method described in U.S. Pat. Nos. 2,361,019 and 2,258,423. Suitable resins of the type contemplated for use in the photoconductive layers of the invention are sold under such tradenames as Vitel PE-101, Cymac, Piccopale 100, Saran F-220 and Lexan. Other types of binders which can be used in the photoconductive layers of the invention include such materials as paraffin, mineral waxes, etc.

A variety of solvents are useful for preparing coating compositions of the binder and selected formula I photoconductors of the present invention. For example, benzene; toluene; acetone; 2-butanone; chlorinated hydrocarbons such as methylene chloride; ethylene chloride; and the like; ethers, such as tetrahydrofuran and the like, or mixtures of such solvents can advantageously be employed in the practice of this invention. 2-butanone; chlorinated hydrocarbons such as methylene chloride; ethylene chloride; and the like; ethers, such as tetrahydrofuran and the like, or mixtures of such solvents can advantageously be employed in the practice of this invention.

Coating thicknesses of the photoconductive composition on a support can vary widely. Normally, a wet coating thickness in the range of about 0.025 mm to about 2.5 mm is useful in the practice of the invention. A preferred range of coating thickness is from about 0.050 mm to about 0.15 mm before drying although such thicknesses can vary widely depending on the particular application desired for the electrophotographic element.

Suitable supporting materials for the photoconductive layers of the present invention can include any electrically conducting supports. Examples include conducting papers, aluminum-paper laminates, metal foils such as aluminum and zinc foils; metal plates, such as aluminum, copper, zinc, brass and galvinized plates; vapor-deposited metal layer (silver, nickel, aluminum) on conventional film supports such as cellulose acetate, poly(ethylene terephthalate), polystyrene and the like.

An especially useful conducting support can be prepared by coating a transparent film-support such as poly(ethylene terephthalate) with a layer containing a semiconductor dispersed in a resin. A suitable conducting coating can be prepared from the sodium salt of a carboxyester lactone of a maleic anhydride-vinyl acetate copolymer or cuprous iodide or the like. Such conducting layers and methods for their optimum preparation and use are disclosed in U.S. Pat. Nos. 3,007,901, 3,245,833 and 3,267,807.

The photoconductive layers of the present invention can be employed in photoconductive elements useful in an electrophotographic process. In a process of this type, an electrophotographic element held in the dark, is given a blanket positive or negative electrostatic charge as desired, by placing it under a corona discharge to give a uniform charge to the surface of the photoconductive layer. This charge is retained by the layer owing to the substantial dark-insulating property of the layer. The electrostatic charge formed on the surface of the photoconductive layer is then selectively dissipated from the surface of the layer by imagewise exposure to light by means of a conventional exposure technique to form a latent electrostatic image on the photoconductive layer. Examples include contact-printing, lens projection of an image, or reflex or bireflex techniques and the like.

The charge pattern produced by exposure is then developed or transferred to another surface and developed by treatment with a developing composition comprising electrostatically responsive particles having optical density. The developing composition is in the form of a liquid dispersion, dust, or powder and generally comprise a pigmented thermoplastic resin called a toner.

One method of applying such a toner to a latent electrostatic image for solid area development is by the use of a magnetic brush such as described in the following U.S. Pat. Nos. 2,786,439; 2,786,440; 2,786,441; 2,811,465; 2,874,063; 2,984,163; 3,040,704; 3,117,884 and Re. 25,779. In liquid developers the developing particles are carried to the image-bearing surface in an electrically insulating liquid carrier. Methods of development of this type are widely known and have been described in U.S. Pat. No. 2,297,691 and Australian Patent No. 212,315.

The developed image can be fixed by heating the toned image. Heating causes the toner resin to melt or fuse into or on the image receiver element. In other cases, a transfer of the charge image or toner image formed on the photoconductive layer can be made to a second support such as paper which would then become the final print after developing and fusing. Techniques of this type are well known in the art and have been described in a number of U.S. and foreign patents, such as U.S. Pat. Nos. 2,297,691 and 2,551,582, and in "RCA Review", Vol. 15 (1954) pages 469–484.

The organic photoconductive layers of the present invention can be used in electrophotographic elements having many structural variations. For example, the layers can be formed as single layers or as multiple layers on a suitable opaque or transparent conducting support. Likewise, the layers can be contiguous or spaced having layers of insulating material or other photoconductive or sensitizing material therebetween. Other configurations differing from those disclosed herein are also useful.

The following examples are included for a further understanding of this invention.

EXAMPLES

A standard thermal crystallization or "snake" test consisted of heating the electrophotographic element for one minute at 90° C. followed by storage of the film sample at room temperature and periodically examining the sample under 200X magnification. The time, in days, weeks or months that the defect is first observed, is recorded. This test accelerates the crystallization of the organic photoconductor present in the element. Under normal conditions the element would only be subjected to this high a temperature during a 5-10 second fixation step.

EXAMPLES 1-4

The electrophotographic element comprised a conductive support bearing a photoconductive layer containing an electrically insulating polyester binder poly-[ethylene-co-isopropylidene-2,2-bis(ethylene oxyphenylene)-terephthalate], one or more organic photoconductors 4-[N-butylamino]-2(p-methoxyphenyl) benzo[b] pyrylium fluoroborate spectral sensitizer and a polysiloxane surfactant of the type described by Cawley in U.S. Pat. No. 3,861,915. The organic photoconductor (OP) content of each element and the results of the thermal test are tabulated in Table II.

TABLE II

| Example No. | Total Binder (grams) | Table I OP (grams) | Total % OP (Based on Binder + OP) | Accelerated Thermal Test (Time delay prior to OP crystallization) |
|---|---|---|---|---|
| 1 | 403.0 | 1 (117 g) | 22.5% | 3 days |
| 2 | 403.0 | 37 (117 g) | 22.5% | 3 days |
| 3 | 80.6 | 35 (7.8 g)<br>32 (7.8 g)<br>1 (7.8 g) | 22.5% | 4 months without developing "snakes" |
| 4 | 86.4 | 35 (10.8 g)<br>32 (3.6 g)<br>1 (7.2 g) | 20.0% | 1 month without developing "snakes" |

These data show that elements containing a mixture of three different organic photoconductors resist formation of snakes to a much greater extent than elements containing only one organic photoconductor.

EXAMPLES 5-6

Aggregate photoconductive elements were formed substantially as described in Light, U.S. Pat. No. 3,615,414, Example 1.

The elements comprised a conducting support and an aggregate photoconductive layer containing a binder combination of bis phenol A polycarbonate (92% by weight based on binder), a polyethylene-co-neopentyl terephthalate polyester resin (8% by weight based on binder) one or more organic photoconductors and aggregate forming pyrylium sensitizers. The organic photoconductor content of these aggregate photoconductive layers and the results of the thermal test are tabulated in Table III.

TABLE III

| Example No. | Total Binder (grams) | Table I OP (grams) | Total % OP (Based on Binder + OP) | Accelerated Thermal Test (Time delay prior to OP crystallization |
|---|---|---|---|---|
| 5 | 40.5 | 1 (27.0 g) | 40 | 1 week |
| 6 40.5 | 35 (9.0 g) | 40<br>32 (9.0 g)<br>1 (9.0 g) | 4 weeks | without developing snakes |

These data show that the invention of the present case is effective in retarding snaking in aggregate photoconductive elements.

EXAMPLES 7-9

The electrophotographic element comprised a conductive support bearing a photoconductive layer containing an electrically insulating polyester blend consisting of about 94% by weight of poly[ethylene-co-isopropylidene-2,2'-bis(ethylene oxyphenylene)-terephthalate] and about 6% by weight poly[ethylene-co-isopropylidene-2,2'-bis(ethylene oxymethylene)terephthalate] one or more formula I organic photoconductors, tri-p-tolyamine, a pyrylium spectral sensitizer and a polysiloxane surfactant of the type described by Cawley in U.S. Pat. No. 3,861,915. The organic photoconductor (OP) content of each element and the results of the thermal test are tabulated in Table IV. The sensitizer used in Examples 7 and 9 was 4-[N-butylamino]-2(p-methoxyphenyl)benzo[b]pyrylium perchlorate. The sensitizer used in Example 8 was 2,4bis(4-ethylphenyl)-6-(2,6-diphenyl-4H-pyran-4-ylidene)-methyl pyrylium fluoroborate.

The data of Table IV shows that combinations of three or more formula I organic photoconductors are effective in retarding development of snakes in homogeneous photoconductive elements of the type described in the examples.

TABLE IV

| Example No. | Total Binder (Grams) | Table I OP (Grams) | Total % OP (Based on Binder + OP) | Accelerated Thermal Test (Time Delay Prior To OP (Crystallization) |
|---|---|---|---|---|
| 7 | 50.4 | 1 (3.65g)<br>35 (3.65g)<br>32 (3.65g)<br>tri-p-tolylamine (3.65g) | 22.5% | 7 Months without developing snakes |
| 8 | 48 | 1 (4.00g)<br>35 (4.00g)<br>47 (4.00g) | 20.0% | 2 Months without developing snakes |

TABLE IV-continued

| Example No. | Total Binder (Grams) | Table I OP (Grams) | Total % OP (Based on Binder + OP) | Accelerated Thermal Test (Time Delay Prior To OP (Crystallization) |
|---|---|---|---|---|
| 9 | 48 | 1 (3.00g)<br>35 (3.00g)<br>32 (3.00g)<br>47 (3.00g) | 20.0% | 7 Months without developing snakes |

Although the invention has been described in considerable detail with particular reference to certain preferred embodiments thereof, variations and modifications can be effected within the spirit and scope of the invention.

We claim:

1. An electrophotographic element comprising a conductive support and an organic photoconductive layer containing a crystallization inhibiting mixture of at least two different organic photoconductors selected from the class of organic photoconductors represented by the formula

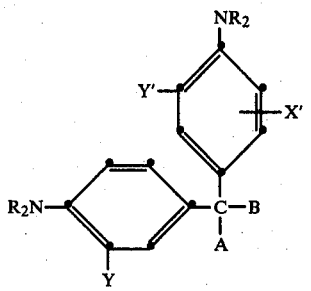

wherein

R is selected from the group consisting of alkyl, aralkyl and substituted and unsubstituted aryl;

X and X', which may be the same or different, are selected from the group consisting of hydrogen, alkyl, alkoxy, hydroxy, $NO_2$ and halogen;

Y and Y', which may be the same or different, are selected from the group consisting of hydrogen, alkyl, alkoxy, hydroxyl, halogen and $NO_2$;

A and B, when taken alone may be the same or different, are selected from the group consisting of hydrogen, alkoxy, hydroxyl, halogen, substituted or unsubstituted aryl, alkyl, cycloalkyl having four to ten carbon atoms, and cycloalkenyl having four to eight carbon atoms; or A and B, when taken together, represents sufficient atoms to form together with the carbon to which they are attached a substituted or unsubstituted carbocyclic ring having from 4 to 10 carbon atoms;

wherein each organic photoconductor may be present in said layer up to the limit of its solubility in the binder; and wherein A and/or B in at least one of said photoconductors is substituted or unsubstituted aryl.

2. In an electrophotographic process wherein the photoconductive layer of a photoconductive element is electrostatically charged, imagewise exposed to light to form an electrostatic charge pattern, and developed to form an image, the improvement wherein said photoconductive layer comprises a crystallization inhibiting mixture of at least two different organic photoconductors selected from the class of organic photoconductors represented by the formula:

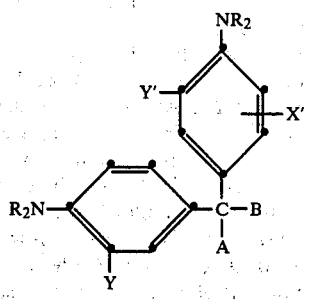

wherein

R is selected from the group consisting of alkyl, aralkyl and substituted and unsubstituted aryl;

X and X', which may be the same or different, are selected from the group consisting of hydrogen, alkyl, alkoxy, hydroxy, $NO_2$ and halogen;

Y and Y', which may be the same or different, are selected from the group consisting of hydrogen, alkyl, alkoxy, hydroxyl, halogen and $NO_2$;

A and B, when taken alone may be the same or different, are selected from the group consisting of hydrogen, alkoxy, hydroxyl, halogen, substituted or unsubstituted aryl, alkyl, cycloalkyl having four to ten carbon atoms, and cycloalkenyl having four to eight carbon atoms; or A and B, when taken together, represents sufficient atoms to form together with the carbon to which they are attached a substituted or unsubstituted carbocyclic ring having from 4 to 10 carbon atoms;

wherein each organic photoconductor may be present in said layer up to the limit of its solubility in the binder; and wherein A and/or B in at least one of said photoconductors is substituted or unsubstituted aryl.

3. An electrophotographic layer comprising an electrically insulating binder and a crystallization inhibiting mixture of at least two different organic photoconductors selected from the class of organic photoconductors represented by the formula:

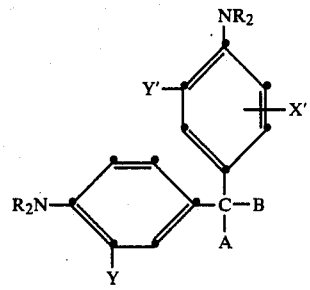

wherein

R is selected from the group consisting of alkyl, aralkyl, and substituted and unsubstituted aryl;

X and X', which may be the same or different, are selected from the group consisting of hydrogen, alkyl, alkoxy, hydroxy, $NO_2$ and halogen;

Y and Y', which may be the same or different, are selected from the group consisting of hydrogen alkyl, alkoxy, hydroxy, halogen and $NO_2$;

A and B, when taken alone, may be the same or different, and are selected from the group consisting of hydrogen, alkoxy, hydroxy, halogen, substituted or unsubstituted aryl, alkyl, cycloalkyl having four to ten carbon atoms and cycloalkenyl having four to eight carbon atoms; or A and B, when taken together, represents sufficient atoms to form together with the carbon to which they are attached a substituted or unsubstituted carbocyclic ring having from 4 to 10 carbon atoms; wherein each organic photoconductor may be present in said layer up to the limit of its solubility in the binder, and wherein A and/or B in at least one of said photoconductors is substituted or unsubstituted aryl.

4. A layer according to claim 3 wherein A and/or B in at least one of said photoconductors is substituted or unsubstituted phenyl.

5. A layer according to claim 3 wherein the organic photoconductors are bis (4-N,N-diethylamino-2-methylphenyl)-4-methylphenylmethane, 1,1-bis(4-N,N-diethylamino-2-methylphenyl)-2-methylpropane and 4,4'-bis-(diethylamino)-2,2'-dimethyltriphenylmethane.

6. A layer according to claim 3, 4 or 5 wherein the total amount of all organic photoconductors present in said layer is from about 5 to about 40 percent by weight.

7. A layer according to claim 3, 4 or 5, wherein the mixture of organic photoconductors is included in an aggregate photoconductive layer.

8. A layer according to claim 3, 4 or 5, wherein each organic photoconductor is present in said layer in equal amounts.

9. A layer according to claim 3, 4 or 5, wherein the binder is selected from the group consisting of bisphenol A polycarbonate and poly[ethylene-co-isopropylidene-2,2-bis(ethyleneoxyphenylene)terphthalate].

10. A layer according to claim 3, 4 or 5, which also includes a triphenylamine type photoconductor.

11. A layer according to claim 3, 4, or 5, which also includes tri-p-tolylamine.

* * * * *

UNITED STATES PATENT AND TRADEMARK OFFICE

CERTIFICATE OF CORRECTION

PATENT NO. 4,301,226

DATED November 17, 1981

INVENTOR(S) Contois and Rule

It is certified that error appears in the above-identified patent and that said Letters Patent are hereby corrected as shown below Column 3, line 56, that part of the formula reading " 2,2" " should read ---2,2'---. Column 8, line 22, after "crystallization", --)-- should be inserted; line 23, the figures have been printed too far to the left of the columns in which they belong, as follows:

TABLE III

| Example No. | Total Binder (grams) | Table I OP (grams) | Total % OP (Based on Binder + OP) | Accelerated Thermal Test (Time delay prior to OP crystallization |
|---|---|---|---|---|
| 5 | 40.5 | 1 (27.0 g) | 40 | 1 week |
| 6 40.5 | 35 (9.0 g) | 40 | 4 weeks | |
| | | 32 (9.0 g) | | without developing snakes |
| | | 1 (9.0 g) | | |

These data show that the invention of the present case is effective in retarding snaking in aggregate photoconductive elements.

and should have been placed as follows:

UNITED STATES PATENT AND TRADEMARK OFFICE

CERTIFICATE OF CORRECTION

PATENT NO. 4,301,226

DATED November 17, 1981

INVENTOR(S) Contois and Rule

It is certified that error appears in the above-identified patent and that said Letters Patent are hereby corrected as shown below

[illegible]

| Example No. | Total Binder (grams) | Table I DP (grams) | Total % DP (Based on Binder + DP) | Accelerated Thermal Test (Time delay prior to DP crystallization) |
|---|---|---|---|---|
| 5 | 40.5 | 1 (27.0 g) | 66 | 1 week |
| 6 | 40.5 | 25 (9.0 g)<br>20 (9.0 g)<br>5 (9.0 g) | 66 | 1 week without developing amines |

These data show that the invention of the present case is effective in extending amines in aggregate photoconductive elements.

Column 9, lines 29-31, that part of the formula set forth as:

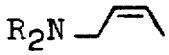

should read

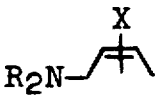

Column 10, lines 16-19, that part of the formula set forth as:

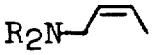

should read

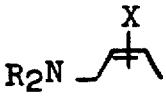

;

UNITED STATES PATENT AND TRADEMARK OFFICE

CERTIFICATE OF CORRECTION

PATENT NO. : 4,301,226

DATED : November 17, 1981

INVENTOR(S) : Contois and Rule

It is certified that error appears in the above-identified patent and that said Letters Patent are hereby corrected as shown below Column 10, lines 58-61, that part of the formuna set forth as:

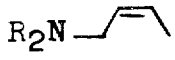

should read

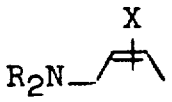

Column 11, lines 17-20, "wherein....aryl." is a separate paragraph and should start flush with the left margin.

Signed and Sealed this

Twentieth Day of July 1982

[SEAL]

Attest:

GERALD J. MOSSINGHOFF

Attesting Officer

Commissioner of Patents and Trademarks